United States Patent [19]

Ashman

[11] 4,356,971

[45] Nov. 2, 1982

[54] METAL SPRAYING APPARATUS

[75] Inventor: Stewart J. Ashman, Dudley, England

[73] Assignee: Metallisation Limited, Dudley, England

[21] Appl. No.: 148,920

[22] PCT Filed: Sep. 14, 1979

[86] PCT No.: PCT/GB79/00151

§ 371 Date: May 12, 1980

§ 102(e) Date: May 12, 1980

[87] PCT Pub. No.: WO80/00544

PCT Pub. Date: Apr. 3, 1980

[30] Foreign Application Priority Data

Sep. 14, 1978 [GB] United Kingdom ..... 36908/78

[51] Int. Cl.[3] ..... B05B 7/22

[52] U.S. Cl. ..... 239/84; 219/76.14

[58] Field of Search ..... 239/81, 83, 84; 219/76.1, 76.11, 76.14, 76.16, 75

[56] References Cited

U.S. PATENT DOCUMENTS 2,765,144 10/1956 Layden ..... 219/75 X

FOREIGN PATENT DOCUMENTS 2615679 10/1976 Fed. Rep. of Germany ..... 239/83
743489 1/1956 United Kingdom ..... 239/83
1225907 3/1971 United Kingdom ..... 239/81
1237064 6/1971 United Kingdom .
1346054 2/1974 United Kingdom ..... 239/81

*Primary Examiner*—Andres Kashnikow
*Attorney, Agent, or Firm*—Merriam, Marshall & Bicknell

[57] ABSTRACT

A metal spraying apparatus comprises a gun having convergent guide passages (36,38) through which metallic wires are fed. An electrical potential is applied across the wires, by conductor elements (54), to cause arcing between the wires where they emerge from the guide passages, which melts the wires. A stream of compressed air causes molten metal droplets to be carried from the arcing zone towards the surface to which a metallic coating is to be applied. The apparatus also comprises a supplying device, to supply electricity and air under pressure to the gun. The conductor elements extend within conduits (18) through which air is fed to the gun, and the gun comprises a valve (9) for cutting off the flow of air through the gun. The supplying device comprises a control device (82) which is responsive to such cut off, to cut off the supply of electricity to the gun.

12 Claims, 8 Drawing Figures

METAL SPRAYING APPARATUS

DESCRIPTION OF INVENTION

A conventional metal spraying apparatus comprises a spraying device comprises a body, feeding mechanism for simultaneously feeding two metallic wires or rods (hereinafter referred to for convenience as "wires") through two guide passages which converge forwardly in the direction of wire feed, connecting means which may be connected to a supply of electricity remote from the device and which establishes an electric potential across said wires to cause an arc to be established between the wires where they emerge from said guide passages so as to melt with wires, and delivery means for delivering a stream of compressed air or other non-combustible gas (hereinafter referred to for convenience as "an air jet") relative to the wires and the arc therebetween so as to cause molten metal droplets to be carried away from the arcing zone on the air jet from the spraying device towards a surface to which a coating of metal is to be applied. Such a metal spraying device is hereinafter referred to as being of the kind specified and an example of such a device is described in the Specification of our U.K. Pat. No. 1,540,810.

Conventionally the wires are drawn by the feeding means from reels; in particular for hand-held spraying devices, the reels are mounted separately from the device itself, and the feeding means operates to draw the wires from the reels into guide sleeves extending from the guide passages of the spraying device.

Conveniently, the feeding mechanism comprises an air motor, so that, additional to the air supply needed to establish the air jet, an air supply must also be provided to drive the air motor. Further air may be utilised to establish air flow around the wires, to reduce the tendency for them to overheat whilst in the guide passages and to blow detritus from the wires.

The particle size of the atomised metal which is carried from the arcing zone, and the smoothness of the finished metallic coating, is dependent upon the rate of air flow through the arcing zone. For this reason, it is desirable to use a high air flow rate through the arcing zone, and typically an air flow rate of about 50 cu.ft. of air per minute is utilised.

In view of the air pressures conventionally used in factory premises and in view of the requirement to retain flexibility of the metal spraying device, it is conventional practice to utilise separate conduits, usually in the form of flexible hoses for the air jet and for the air motor, since if all the air were supplied through a single hose, problems would be caused by the size and inflexibility of the hose.

Additionally, conventionally the spraying device is connected to a source of electricity by two insulated conductors, which conventionally are copper stranded cable having an effective cross-sectional area of 70 sq.mm. capable of delivering a current of 300 amps to the metal spraying device.

Thus, a conventional spraying device of the kind specified may comprise six supply conduits, one being an air hose for the air jet, one being an air hose for the air motor, two wire guide sleeves for the wires themsevles, and two insulated electrical conductors.

It is frequently desired to spray a metal surface by the use of a spraying device of the kind specified, in the form of a hand-held gun. Typically, such a gun weighs about 14 lbs., but, because of the six supply conduits, is not easy to operate such a spray gun in a manner which provides high quality metal spray finishes.

An additional difficulty which is encountered is that it is often necessary to use the device some distance from the supply of electricity, some of the supply conduits being trailed across the floor. A not uncommon problem occurs when a fork lift truck or the like requires to traverse the floor area, since utilising the conventional copper stranded cable construction, the weight of a fork lift truck on these can crush the conductor causing a hot spot to develop. Thus, it is a general requirement that a fork lift truck shall not be driven across the insulated conductors, but because of the difficulty involved in adhering to this rule, it is not always observed.

It is one of the various objects of this invention to provide a metal spraying device of the kind specified in which some at least of the problems set out above are reduced.

According to a first aspect of this invention there is provided a metal spraying device comprising a body, feeding mechanism for feeding two metallic wires through guide passages which converge forwardly in the direction of wire feed, connecting means which may be connected to a supply of electricity remote from the device and which establishes an electric potential across said wires to cause an arc to be established between the wires where they emerge from the guide passges, and means for delivering an air jet relative to the wires and the arc therebetween so as to cause molten metal droplets to be carried away from the arcing zone on the air jet from the device towards a surface to which a coating of metal is to be applied, wherein electric current is supplied to the device along conductor elements extending within conduits through which air is fed under pressure to the device.

Preferably, some at least of the air which is fed under pressure through said conduits is utilised to establish the air jet. Additionally, where the feeding mechanism comprises an air motor, some at least of the air which is fed under pressure through said conduits is utilised to drive the air motor. Further, advantageously some at least of the air which is fed under pressure through the conduits is fed to the guide passages through which the metallic wires are fed, reducing the temperature of the metallic wires, and blowing detritus therefrom so that the wires exit from the guide passages in a relatively clean state.

Preferably, the conductor elements are of solid cross-section, and advantageously a plurality of conductor elements extend within each conduit, thus providing a relatively high surface area/cross-sectional area ratio.

In this manner, by combination of one air and one electricity supply in for example a single flexible hose, the number of supply connectors to the supply device may be reduced, typically from six to four.

The combined air and electricity feed conduits may still be provided by ⅜" hose. Thus, where seven conductors of solid cross-section extend through each hose, each conductor being for example of 1.5 mm. diameter, the effective diameter of the hose is reduced, as far as air flow capability is concerned, to an equivalent 5/16" hose. Two such hoses have an effective delivery rate of 90. cu.ft. per minute, which allows both adequate air to be supplied to the air motor for feeding of the metallising wires, and a significantly higher air feed for the air jet, with superior spraying results.

Additionally, flow of air over the conductor elements retain them cool, maintaining the electrical resistance at a relatively low level. This allows a total conductor cross-section to be used which is smaller than would otherwise be the case, and reduces the power consumption of the device.

Further the flow of air over the conductor elements increases the temperature of the air delivered to the arcing zone, typically to 100° C., which further significantly improves the quality of spraying, not only because of the approach in temperature of the air towards that of the melted wire, reducing deleterious effects caused by a high temperature disparity, but also improves quality because of the removal of moisture from the jet stream which is afforded by this increase in temperature.

It will be appreciated that this invention is particularly useful where the metal spraying device is in the form of a hand-held gun, since in this case the reduction in weight, and increase in flexibility afforded by the reduction in the number of connections is most useful. However, certain aspects of the invention, particularly in relation to the increase in the temperature of the air jet, and the consequent improvement in the quality of spraying which may be achieved thereby, together with a reduction in the power consumption on the device by virtue of the cooling effect of the air flow of the conductor elements, may be applied to metal spraying devices other than in the form of hand-held spray guns.

Additionally, since it is common practice to operate a metal spraying device of the kind specified some distance from the source of electric power and the source of compressed air, it is desirable to provide on the device a means by which the supply of electricity can be switched on or off, rather than requiring the operator to return to the source. This is conventionally effected by the use of a low power electric supply cable extending between the source of electricity and the spraying device, and in particular to a switch on the spraying device which an operator may use to switch the supply of electricity to the device on or off. Such control cables are additionally cumbersome, and may at times be hazardous.

According to a second aspect of this invention, there is provided apparatus for applying a coating of metal to a surface and comprising:

a metal spraying device comprising a body, feeding mechanism for simultaneously feeding two metallic wires through guide passages which converge forwardly in the direction of wire feed, connecting means for connecting an electric potential across said wires to cause an arc to be established between the wires where they emerge from said guide passages so as to melt the wires, and delivery means for delivering a stream of compressed air relative to the wires and the arc therebetween so as to cause molten metal droplets to be carried away from the arcing zone on the air jet from the device towards the surface to which a coating of metal is to be applied; and a supplying device, adapted to supply electricity and air under pressure to the device;

wherein the spraying device is connected to the supplying device by conduits through which electric power and air under pressure are supplied to the device, wherein the spraying device comprises a valve which may be operated to cut off or reduce the flow of air through the body, and the supplying device has associated therewith control means which is responsive to such cut off or reduction, to cut off the supply of electricity to the device.

The valve may be operated in consequence of operation of the feeding mechanism. Thus, where the feeding mechanism comprises an air motor, the valve is provided by the trigger of the device which operates the air motor. Thus, when operation of the air motor teminates, the supply of electricity to the device is similarly terminated, and when the air motor is restarted, supply of electricity to the device is reestablished.

Alternatively however, the valve is operative in the stream of air which establishes the air jet, and is preferably separate from the air flow to the air motor. In this manner, merely by cutting off the air jet by means of the valve, the operator may effect electrical disconstruction from the electricity power source.

Advantageously, the control means which is responsive to cut off or reduce the air flow through the device to cut off the supply of electricity to the device, is provided by the pressure switch (as aforesaid) which is responsive to an increase in air pressure at the supplying device.

The second aspect of the invention is particularly useful where the metal spraying device is in the form of a hand-held gun, and is particularly advantageous in reducing the weight of such a gun, and increasing its flexibility when utilised in conjunction with the first aspect of the invention. Thus, where electric current is supplied to the device along conductor elements extending with the conduits through which air under pressure is fed to the spraying device, should air flow through either of the hoses be impeded, by for example a heavy weight crushing the conduit, the supply of electricity to the spraying device will be cut off immediately. However, should a fork lift truck drive over the hose, although a momentary interruption to the air flow will be produced, because of the nature of the conductive elements, and the resilience of the hose itself, air flow will almost immediately be continued without any significant disturbance to the air jet, and without the requirement for the spraying device to be shut down.

It will however be appreciated that the second aspect of the invention may also be used to advantage in a metal spraying device, the electricity supply and compressed air supply to which are separate.

There will now be give a detailed description, to be read with reference to the accompanying drawings, of a metal spraying apparatus, comprising a hand-held spraying device, which is a preferred embodiment of this invention, and which has been selected to illustrate the invention by way of example, with reference to the accompanying drawings in which.

Figure 1:
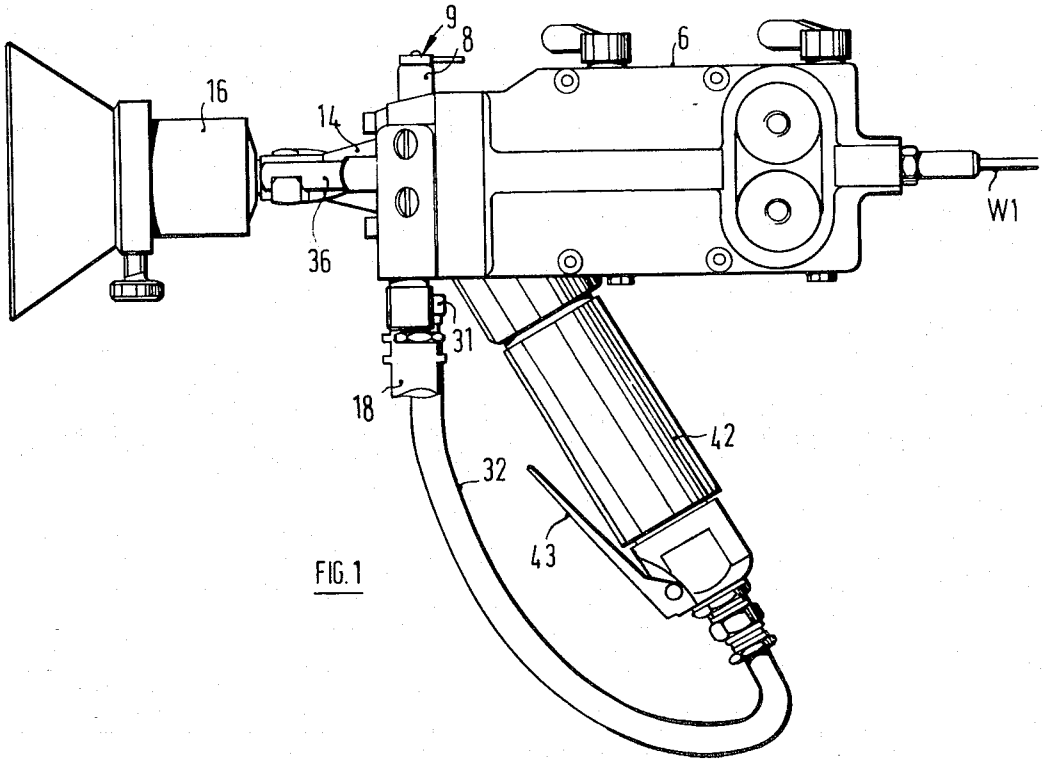
FIG. 1 is a side elevation of the device which is the preferred embodiment.

The preferred embodiment of the invention comprises a metal spraying device, in particular a hand-held metal spraying gun, and is similar in certain respects to the device illustrated by way of example in the Specification of our U.K. Pat. No. 1,540,810, to which reference may be made for details of construction and operation not hereinbefore given.

The metal spraying gun comprises a housing 6, a manifold assembly 8 secured to a forward end of the housing, a stem portion 14 secured to and extending forwardly from the manifold assembly, and a head 16 secured to a forward end of the stem portion 14.

The manifold assembly 8 comprises a central portion 10 of insulating material (see FIG. 3) and two outer, conductive portions 12 secured to the central portion 10. The spray gun also comprises two supply conduits 18, in the form of rubber hose of ⅜" diameter, each of which define an interior supply passage 20, and each of which is connected to one of the outer portions 12 of the manifold assembly by a screw fitting 22.

Figure 5:
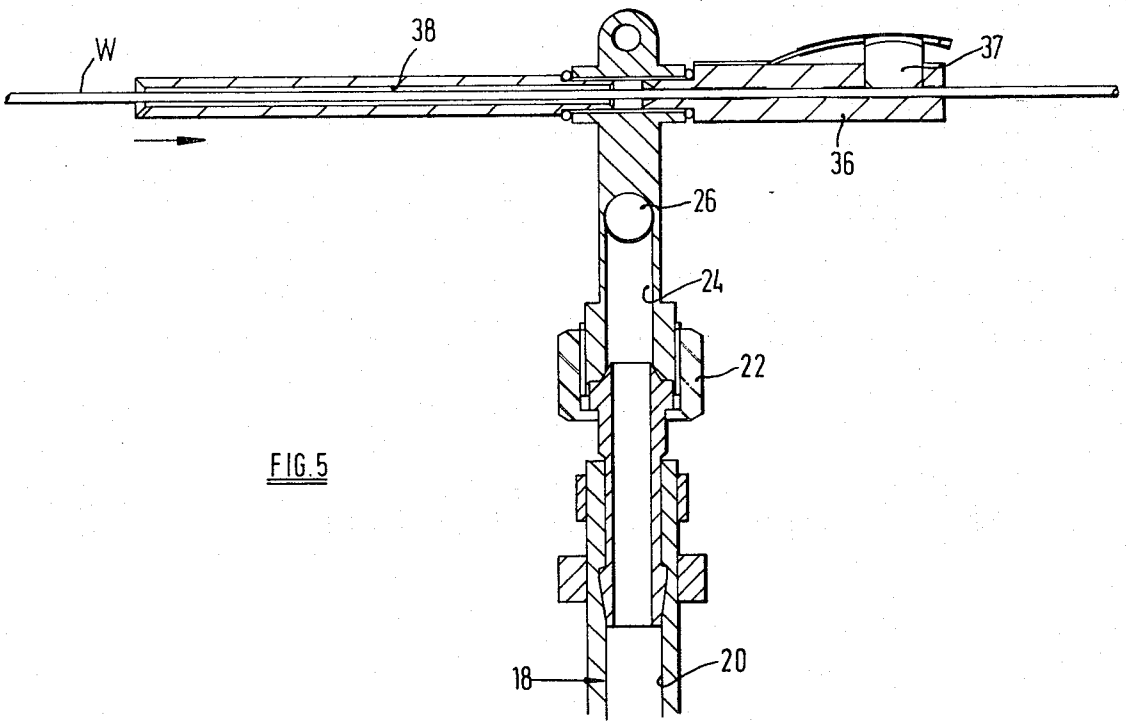
FIG. 5 is a sectional view taken on the line V—V of FIG. 3.
Figure 7:
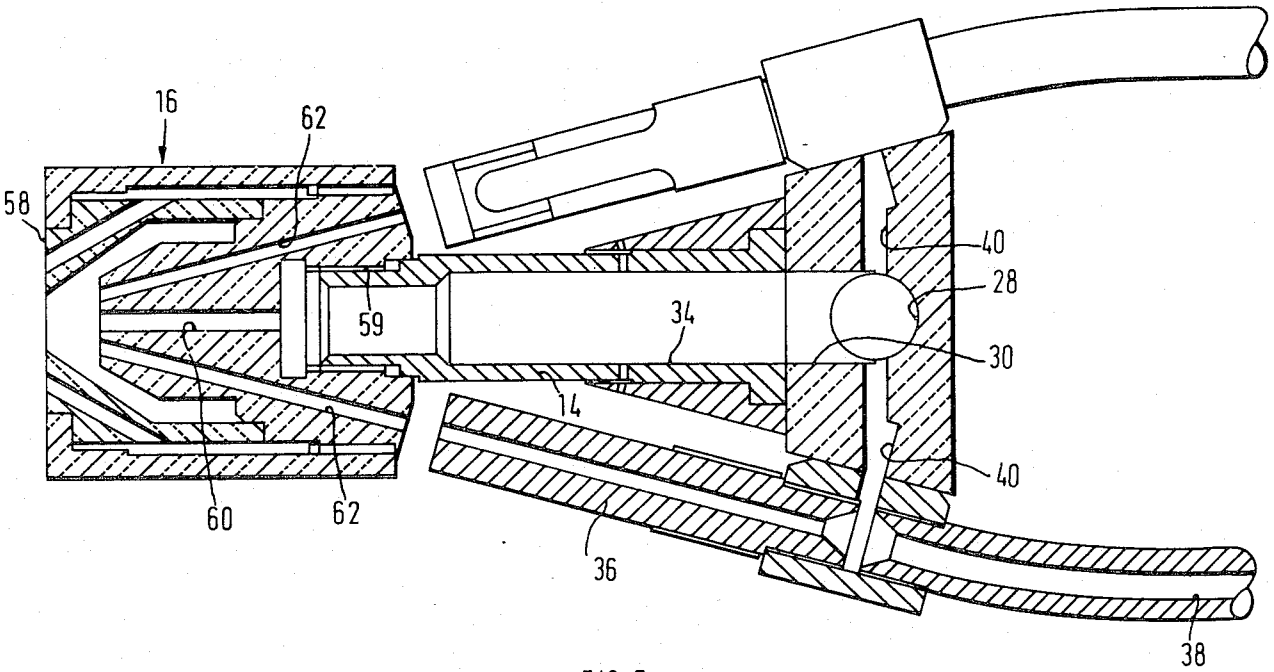
FIG. 7 is an elongate view of part of FIG. 6.

The manifold assembly 8 comprises two passages 24, each of which is in connection with one of the supply passages 20, and which extend to a cross passage 26 (see also FIG. 5). A further cross passage 28 in the central portion 10 extends through the passage 26, an upper end portion extending to a transverse passage 30 (see FIG. 7) and to two supplementary air passages 40 and a lower end portion extending to a fitting 31 to which a flexible conduit 32 may be connected.

Mounted in the passage 28, and operative between the cross passage 28 and the passage 30, and the air passages 40, is a spool valve 9 having a central bore, a central outlet and two transverse outlets. A shaft of the spool valve extends upwardly through the manifold assembly 8, and has secured thereto a handle 9*a* by which the spool valve may be rotated within the passage 28. When the spool valve 9 is in its operative position (shown in FIG. 5) the cross passage 28 is in communication with the transverse passage 30 by way of the central outlet, and the passage 28 is in communication with the supplementary air passages 40 by way of the transverse outlets of the spool valve. However, the spool valve 9 may be rotated axially through 180°, to an inoperative position, in which communication between the cross passage 28 and the transverse 30 is blocked, whilst communication between the cross passage 28 and the supplementary air passages 40 is maintained.

The head 16 is mounted on the stem portion 14, the head being provided with an inlet 59 into which an end portion of the stem 14 is secured. The head 16 is formed in one piece from an insulating material, preferably a ceramics material, by a machining operation. Alternatively, however, the head may be formed from plastics material (see FIG. 7).

Extending axially through the head from the inlet 59 is an air passage 60 which constitutes delivery means, through which compressed air may be fed from an axial passage 34 of the stem. Extending through the head, lying in axial plane thereof, are two guide passages 62,62, said guide passages converging towards and existing through a forwardly presented end face 58 of the head.

Figure 6:
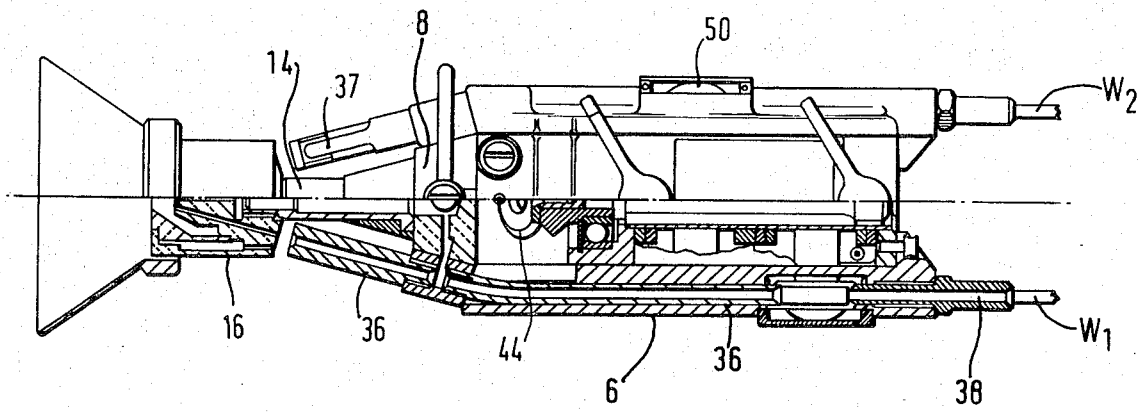
FIG. 6 is a plan view, part in horizontal section, of the device.

Extending through the housing 6, one either side of the spray gun (FIG. 6) are two guide tubes 36, each defining an interior guide passage 38. At a forward end region of the spray gun, the guide tubes 36 converge, and at a point adjacent the head 16, the guide passages 38 are each in alignment with one of the guide passages 62 of the head 16.

Figure 2:
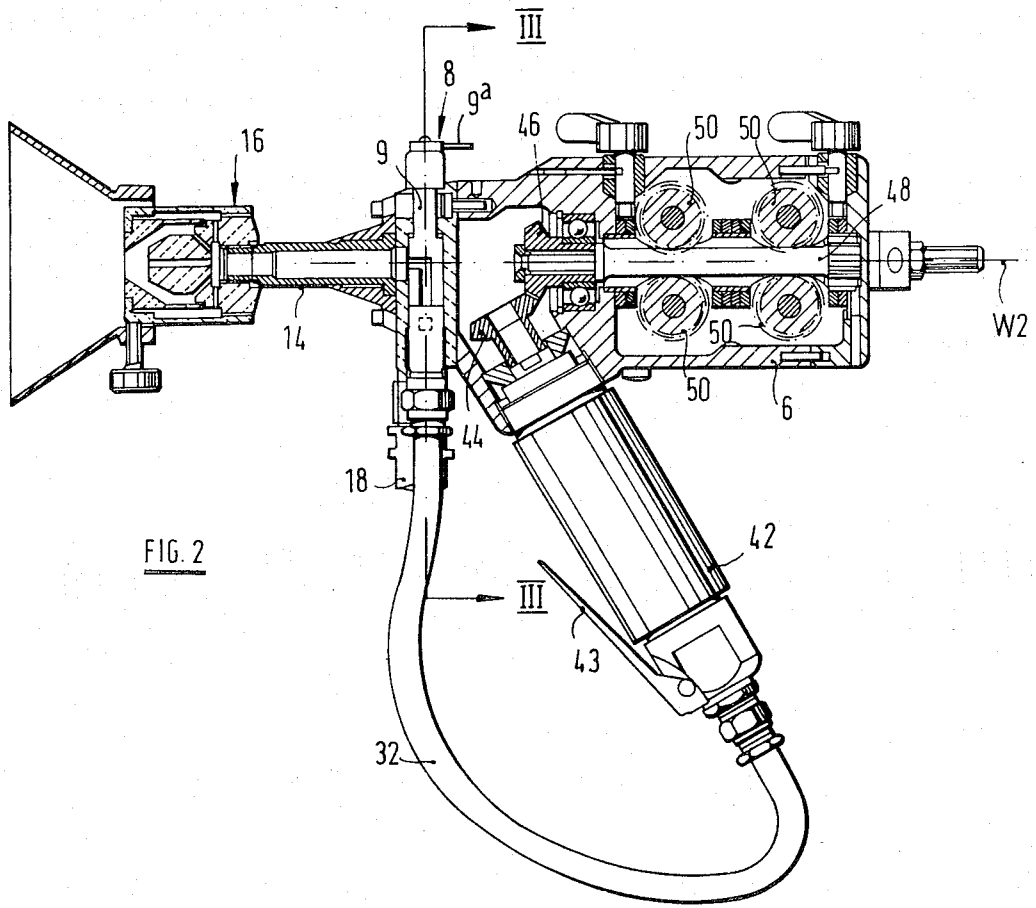
FIG. 2 is a vertical sectional view of the device taken on the longitudinal centre line thereof.

Secured to an underside of the housing is an air motor 42, (FIGS. 1 and 2). In operation of the air motor initiated by a trigger level 43, the air motor drives gear wheels 44 and 46 to axially rotate a central spindle 48. These in turn are connected to feed wheels 50 which extend through slots in the guide tubes 36, the air motor, together with the gear wheels 44 and 46, the central spindle 48 and feed wheels 50 constituting feeding mechanism of the spraying device.

In the use of the spray gun, metallising wires, in the form of elongate rods of circular cross-section, W1 and W2, are fed through the guide passages 38 in the guide tubes 36, and into the guide passages 62 of the head 16. By operation of the air motor 42, the feed wheels 50 grip these metallic wires, and feed them along the guide tubes 36 in the direction of forward convergence of the guide tubes and into the head.

Extending through each of the two supply conduits 18 is a conductor means in the form of a plurality of conductor rods 54 of solid, conveniently circular cross-section. In the preferred embodiment, in each suppy conduit 18 there are seven such conductor rods, the diameter of each being 1.5 mm.

At the point where each supply conduit is connected to the manifold assembly, conductive contact is established between the conductor rods and one of the two outer conductive portions 12 of the manifold assembly. Each guide tube 36, at a point where it passes through the manifold assembly, comprises a pressure contact element 37, which is urged by a spring towards the longitudinal axis of the guide passage 38 to ensure good electrical contact with the metallising wire therein.

Figure 8:
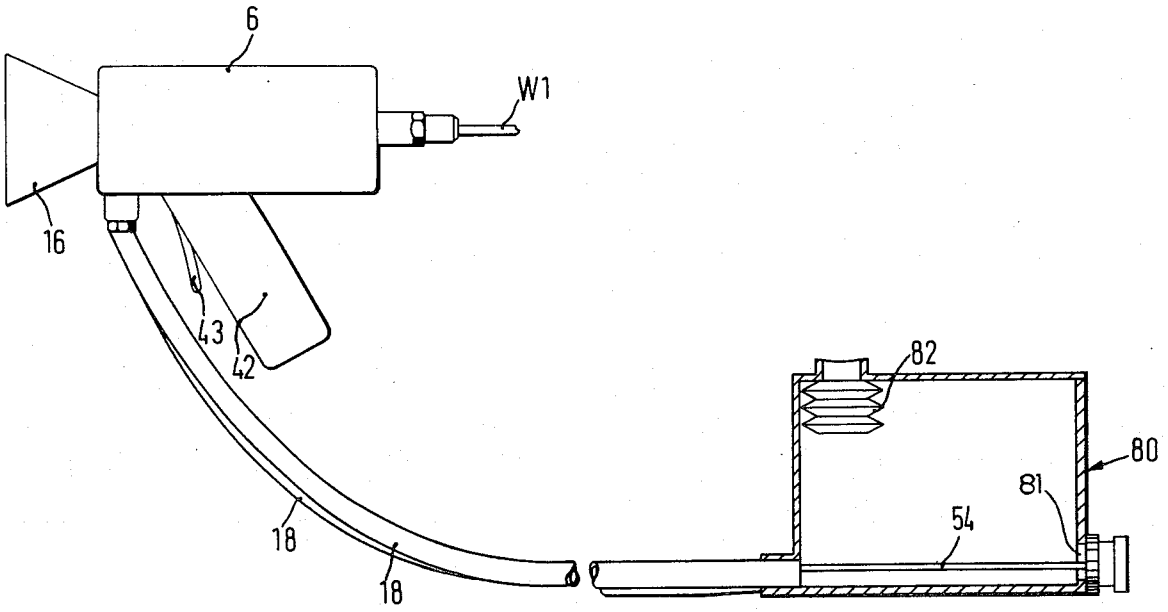
FIG. 8 is a schematic side elevation showing the spraying device in conjunction with a supplying device for the supply of electricity and air under pressure to the spraying device, and which together with the spraying device, form the apparatus which is the preferred embodiment of this invention.

The ends of the supply conduits 18 remote from the metal spraying gun are connected to a supplying device 80 of the apparatus (see FIG. 8) adapted to supply air under pressure, (conveniently about 120 p.s.i.) and the conductor rods 54 of each are connected to a respective terminals 81 of a direct current supply (see FIG. 8). Conveniently the connection of each of the supply passages 20 to the source of air under pressure is carried out through a pressure sensitive switch, such as is indicated at 82 in FIG. 8, each of which being responsive to a build up of pressure in its rspective supply passage to shut off the supply of electricity to both of the conductor rods.

In the use of the metal spraying apparatus which is the preferred embodiment of this invention, the supplying device may be activated to supply compressed air to both the supply conduits 18, and to establish a potential difference across the two sets of conductor rods 54. Air flows through the two supply passages 20, via the passage 24 of the outer sections of the manifold assembly to the cross passage 26 of the central insulated portion thereof. The bulk of the air flow then flows upwardly through the cross passage 28 and with the spool valve 9 in its operative position, through the transverse passage 30, from which it flows along the axial passage 34 of the stem portion 14 and into the air passage 60 of the head 16, emerging therefrom in the form of an air jet.

Simultaneously, some air flows downwardly through the cross passage 28 along the conduit 32, to the air motor 42, which may be operated by means of the trigger 43 to drive the feed wheels 50, to commence feeding of the two metallising wires through the guide passages 38 and into the head 16.

Electrical contact is established between each of the wires and a respective set of conductor rods 54 via one or other of the outer conductive portions 12 of the manifold assembly, such contact being ensured by the pressure pads 37. Thus, as the two wires emerge from the guide passages 62 at the end face 58 of the head, an electric arc is established between the wires. This produces a continuous melting of the wires as they are continuously fed forwardly, and droplets of molten metal are carried forwardly from the spray gun on the air jet passing through the air passages 60 of the head.

On release of the trigger 43, the air motor 42 ceases operation, and the arc breaks down as the leading end portions of the two metallising wires are eroded. However, upon recommencement of operation of the air motor, an arc is again established, and metal spraying may be continued.

During operation of the apparatus, a relatively small air flow through the supplementary air passage 40 (see FIGS. 3 and 6) takes place which establishes flow of air within the two guide passages 38 around the two metallising wires. This prevents or minimises tendancy for the metallising wires to carry into the guide passages 38 small pieces of foreign matter, which might otherwise be carried forwardly into the arcing zone, or interfere with the electrical contact between the pressure pads 37 and the metallising wires themselves. Additionally, such air flow tends to reduce the temperature of the metallising wires, and reduces tendancy for them to melt or oxidise within the guide passages 38.

By the use of this invention, flow of air through the supply conduits 18 around both sets of conductor rods 54 serves to reduce the temperature of the conductor rods, notwithstanding the high current load carried thereby. This allows a total cross-sectional area of electrical conductor to be used to carry current from the distribution box to the spray gun, which is sufficiently small so as not to interfere significantly with the quantity of air which may be delivered to the spray gun by the use of the two supply conduits. Specifically, in the preferred embodiment, the effective cross-sectional area of the two conduits (as far as air flow is concerned) is reduced from a nominal $2\times\frac{3}{8}''$ to $2\times5/16''$. This allows an effective delivery rate of 90 cu. ft. per minute to the spray gun, which allows both adequate air to be supplied to the air motor for feeding the metallising wires, and a significantly higher air feed for the air jet with superior spraying results.

Additionally, in view of the temperature increase caused in the air due to its flow over the conductor rods 54, moisture is removed from the air, and this, together with the increase in temperature of the air itself, increase the quality of spraying which may be achieved by the use of a spray gun.

In the event of a momentary blockage of air flow, such as a fork lift truck being driven over one or both of the supply conduits, the increase in pressure sensed by one or both the pressure sensitive switches 82 need not be such as will cause a break in the supply of electricity to the two sets of conductor rods. However, if such air flow is impeded for any significant period of time, the pressure sensitive switch 82 will be operative to cut off the supply of electricity, to prevent over heating of the conductor rods.

By rotation of the spool valve 9, the operator can readily cut off the supply of compressed air to the head 16. Such closing of the spool valve 9 is also effective to significantly reduce the flow of air through the spraying gun, to an extent such that there is a build up of air under pressure within the conduits 18, and after a very short time a similar operation of the pressure sensitive switch hereinbefore mentioned is caused to cut off the supply of electricity to the spraying gun, in the same way as blockage of the air flow conduits may cause a break in the supply of electricity.

In this manner, the operator may electrically isolate the spray gun from the source of the electricity (which may be some distance from the spraying gun) without the need for separate control means extending from the spraying gun to the electricity supply.

Figure 3:
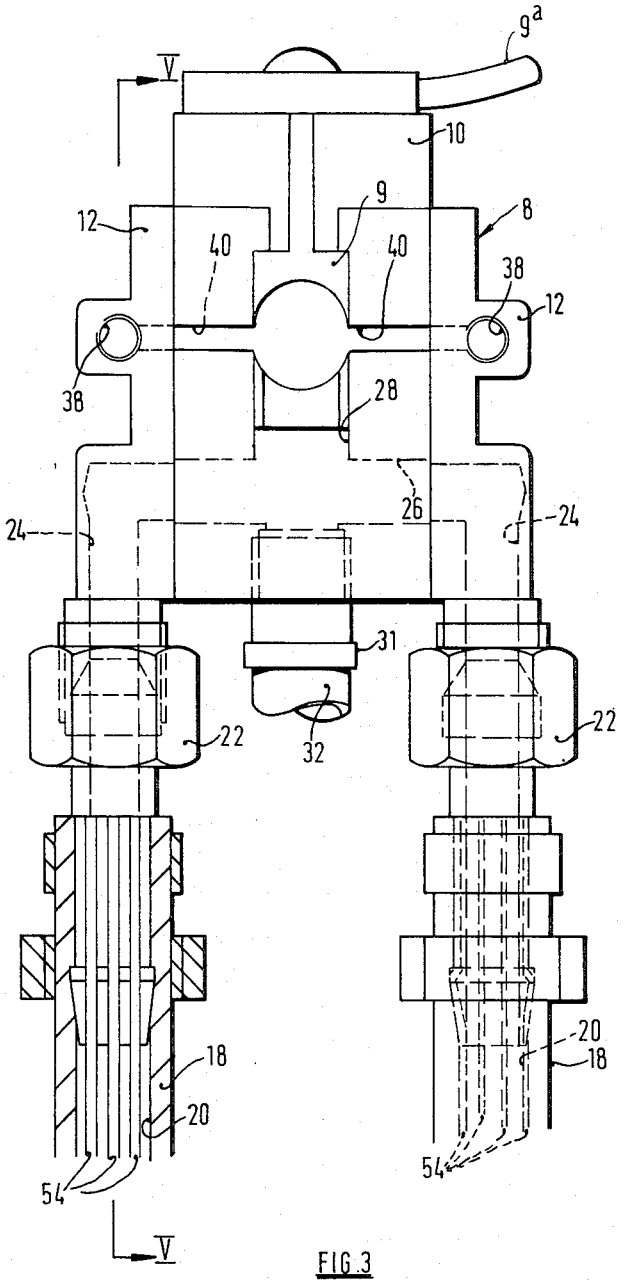
FIG. 3 is a vertical sectional view, taken on the line III—III of FIG. 2, of part of a manifold assembly of the device.
Figure 4:
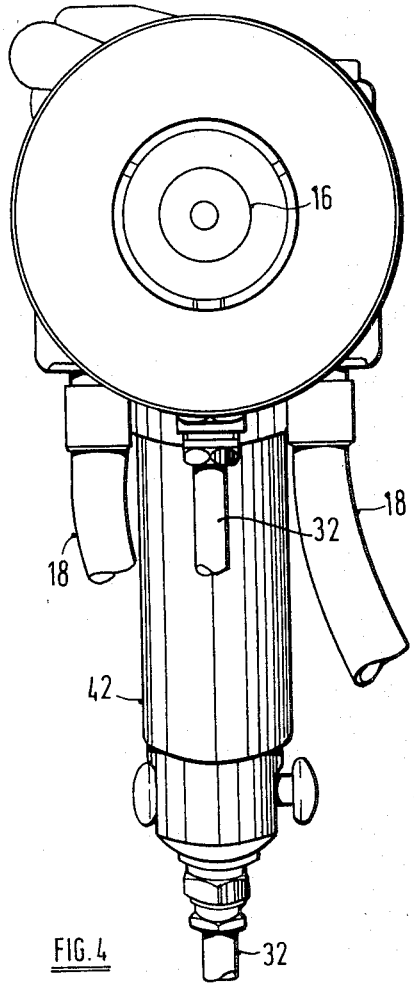
FIG. 4 is a front elevation of the device.

In the arrangement shown in FIG. 3, closing of the spool valve 9, whilst being effective to terminate the flow of air through the transverse passage 30, nevertheless maintains air power through the conduit 32, to the air motor 42. The rate of utilisation of air by the air motor is insufficient significantly to vary the operation of the pressure sensitive switch to closing of the spool valve 9, and this allows the facility of operation of the air motor to advance the metallising wires within their conduits to a point of contact in the vicinity of the arcing zone, preparatory to a recommencement of the metal spraying operation.

In the preferred embodiment, closing of the spool valve is not effective to cut off the supply of air to the supplementary air passages 40.

It will however be appreciated that whereas in the preferred embodiment the feeding mechanism is provided by an air motor, if desired, an electric motor may be used to advance the metallising wires through the device. In such a construction, advantageously some air (for example that flowing through the conduit 32) may be utilised to cool the electric motor.

It will be apprecited further that whereas in the preferred embodiment, cutting off of the high current electricity supply to the spraying device is effected by a pressure sensitive switch located in one or both of the air supply conduits, or in an air distribution box to which such conduits are connected, other forms of flow sensing means may be utilised, such as simple pressure differential switches, or vane switches which are retained in a first condition by actual flow of air, and which moved to a second condition (corresponding to a cutting off of the high current electricity supply) by cessation or significant reduction in the rate of flow of air.

I claim:

1. Apparatus for applying a coating of metal to a surface, and comprising:

(a) a metal spraying device comprising a body, an air motor mounted on the body for simultaneously feeding two metallic wires through guide passages in the body which guide passages converge forwardly in the direction of wire feed, connecting means for connecting an electric potential across said wires to cause an arc to be established between the wires where they emerge from said guide passages so as to melt the wires, and delivery means in the body through which an air jet may be directed from the body towards the point of convergance of the wires and the arc therebetween so as to cause molten metal droplets to be carried away from the arcing zone on the air jet from the device towards the surface to which a coating of metal is to be applied; and (b) a supplying device, adapted to supply electricity and air under pressure to the device;

wherein the spraying device is connected to the supplying device by conduits through which electric power and air under pressure are supplied to the device, the air under pressure being supplied in sufficient quantity for the establishment of the air jet and for the operation of the air motor and wherein the spraying device comprises a valve on the body which may be operated to cut off the air jet, and the supplying device has associated therewith control means which is responsive to operation of the valve to cut off the air jet to cut off the supply of electricity to the device, but which does not respond to termination of operation of the air motor to cut off the supply of electricity to the device.

2. Apparatus according to claim 1 wherein the control means is provided by a pressure switch which is responsive to an increase in air pressure at the supplying device.

3. Apparatus according to claim 1, comprising two conduits extending from the supply device to the metal spraying device, within which conduits conductor elements for the supply of electric current to the spraying device extend and through which air under pressure is fed to the delivery means, the supply device comprising a pressure-responsive switch, which is responsive to a cessation or reduction in the rate of flow of air from the supply device to the spraying device to cut off the supply of electricity to the spraying device.

4. Apparatus according to claim 1 wherein two conduits extend from the supply device to the body, within each of which there extends a plurality of electrically conductive elements of solid cross-section, both said conduits being connected to the supply of air under pressure whereby air under pressure may flow from the supply thereof to the body over the surfaces of the electrically conductive elements.

5. Metal spraying apparatus comprising:

(a) a spraying device comprising a body, a feeding mechanism on the body for feeding metallic wires through two guide passages in the body, said guide passages converging forwardly in the direction of wire feed, and delivery means in the body through which a jet of air under pressure may be delivered towards the point of convergence of the guide passages; and (b) a supply device remote from the spraying device and which comprises an electricity supply comprising first and second terminal means, and means to apply an electric potential across said first and second terminal means, and a supply of air under pressure;

wherein the spraying device comprises an inlet manifold comprising a central section and two outer sections on opposite sides of the central section, and the apparatus comprises a first conduit extending from the supply device to a first of the outer sections of the manifold within which conduit a first conductive means extends from the first terminal means to said first outer section and through which conduit air under pressure is fed from the supply thereof to said first outer section, said first outer section of the inlet manifold providing means to establish electrical connection between the first conductive means and one of the wires, and a second conduit extending from the supply device to a second of the outer sections of the manifold within which conduit a second conductive means extends from the second terminal means to said second outer section and through which conduit air under pressure is fed from the supply thereof to said second outer section, said second outer section of the inlet manifold providing means to establish electrical connection between the second conductive means and the other of said wires, the supply of air delivered by at least one of the conduits to the inlet manifold being delivered by passage means extending through the manifold from one of the outer sections to the central section thereof to said delivery means in the establishment of the jet of air under pressure.

6. Metal spraying apparatus according to claim 5, wherein the feeding mechanism is operated by air under pressure and the supply of air delivered by at least one of the conduits to the inlet manifold is also delivered by passage means extending through the manifold from an outer section to the central section thereof to the feeding mechanism.

7. Apparatus according to claim 5, wherein the delivery means extends through the central section of the inlet manifold and passage means extends from both outer sections to the delivery means, whereby air which flows through both conduits is used in the establishment of the jet of air under pressure.

8. Apparatus according to claim 6, wherein a delivery passage in air-flow communication with the delivery means extends from the central section of the inlet manifold to the feeding mechanism, whereby air which flows through both conduits is utilized in the operation of the feeding mechanism.

9. Apparatus according to claim 5, wherein the central section of the inlet manifold is of insulating material, and the outer sections thereof are each of electrically conductive material, insulated one from the other.

10. Apparatus according to claim 5, wherein the whole of the air supply required by the spraying device is provided by the air which is fed under pressure through said conduits, and wherein the conductive means comprises a plurality of conductor elements of solid cross-section within each conduit.

11. Metal spraying apparatus comprising:

(a) a spraying device comprising a body, guide passages in the body, an air motor on the body for feeding metallic wires through the guide passages, said guide passages converging forwardly of the device in the direction of wire feed through the guide passages, and delivery means in the body through which a jet of air under pressure may be directed from the body towards the point of convergence of the metallic wires; and (b) a supply device remote from the spraying device and which provides a supply of electricity and a supply of air under pressure;

wherein two conduits extend from the supply device to the body, within each of which there extends a plurality of electrically conductive elements of solid cross-section, both said conduits being connected to the supply of air under pressure whereby air under pressure may flow from the supply thereof to the body in sufficient quantity for the establishment of the air jet and for the operation of the air motor, the air flowing over the surfaces of the electrically conductive elements and the electrically conductive elements in each of the conduits provide for the establishment of electrical conduction between one of the terminals of the electricity supply and one of the metallizing wires.

12. Apparatus according to claim 11 wherein the spraying device comprises a valve on the body which may be operated to cut off or reduce the flow of air through the body, and the supplying device has associated therewith control means which is responsive to such cut off or reduction to cut off the supply of electricity to the device.

* * * * *